US007802711B2

(12) United States Patent
Fuenfer

(10) Patent No.: US 7,802,711 B2
(45) Date of Patent: Sep. 28, 2010

(54) HAND-HELD POWER TOOL WITH A PNEUMATIC PERCUSSION MECHANISM

(75) Inventor: Josef Fuenfer, Koenigsbrunn (DE)

(73) Assignee: Hilti Aktiengesellschaft, Schaan (LI)

( * ) Notice: Subject to any disclaimer, the term of this patent is extended or adjusted under 35 U.S.C. 154(b) by 142 days.

(21) Appl. No.: 12/218,665

(22) Filed: Jul. 16, 2008

(65) Prior Publication Data

US 2009/0020302 A1 Jan. 22, 2009

(30) Foreign Application Priority Data

Jul. 19, 2007 (DE) ..... 10 2007 000 391

(51) Int. Cl.
*B25D 11/10* (2006.01)
*B25D 9/26* (2006.01)

(52) U.S. Cl. ..... 227/130; 227/110; 173/204; 173/120

(58) Field of Classification Search ..... 227/130, 227/110; 173/204, 120
See application file for complete search history.

(56) References Cited

U.S. PATENT DOCUMENTS 3,603,406 A * 9/1971 Kahn ..... 173/108
3,948,051 A * 4/1976 Marshall ..... 60/542
4,091,981 A * 5/1978 Moriguchi et al. ..... 227/8
4,509,669 A * 4/1985 Elliesen ..... 227/130
4,605,073 A * 8/1986 Nilsson et al. ..... 173/51
4,688,645 A * 8/1987 Muller ..... 173/200
5,366,025 A * 11/1994 Dutschk et al. ..... 173/109
D410,182 S * 5/1999 Etter et al. ..... D8/69
6,041,603 A * 3/2000 Phillips ..... 60/632
2008/0283260 A1* 11/2008 Kramer et al. ..... 173/128

* cited by examiner

*Primary Examiner*—Brian D Nash
(74) *Attorney, Agent, or Firm*—Abelman, Frayne & Schwab

(57) ABSTRACT

A hand-held power tool includes a pneumatic percussion mechanism (20) having a driving member (22) reciprocating in the guide tube (21), a percussion member (23) driven by the driving member (22), and an air spring (24) located between the driving member (22) and the percussion member (23) transmits a reciprocating movement of the driving member (22) to the percussion member (23), The hand-held power tool further includes a motor-driven elongate swashplate member (29) for reciprocating the driving member (22) a displacement stroke of which is adjusted by an adjusting member (31) displaceable along a longitudinal extent of a swashplate member (29) for adjusting a swashplate angle that determines the displacement stroke of the driving member (22).

10 Claims, 3 Drawing Sheets

HAND-HELD POWER TOOL WITH A PNEUMATIC PERCUSSION MECHANISM

BACKGROUND OF THE INVENTION

1. Field of the Invention

The present invention relates to a hand-held power tool such as, e.g., a chisel or combination hammer and including a pneumatic percussion mechanism defining a central percussion axis and having a guide tube, a driving member reciprocating in the guide tube, a percussion member driven by the driving member, and an air spring located between the driving member and the percussion member for transmitting a reciprocating movement of the driving member to the percussion member, a motor for driving the percussion mechanism, a motor-driven elongate swashplate member for reciprocating the driving member, and an adjustment device for adjusting a displacement stroke of the driving member which is determined by a swashplate angle.

2. Description of the Prior Art

German Publication DE 32 05 141 A1 discloses a hand-held power tool formed as an electrically driven hammer drill including an air cushion percussion mechanism driven by a swashplate member of a swashplate drive. The percussion mechanism includes a driving member such as, e.g., a driving piston displaceable in a guide tube and axially reciprocated a swashplate member. The driving member drives, via the air cushion or the air spring, a percussion member likewise displaceable in the guide tube and which imparts blows, via an anvil, to a working tool receivable in a tool holder provided in the front of the power tool. For adjusting a maximal stroke path of the driving member, a swashplate angle of the swashplate member is adjusted in three steps by an adjustment device that is formed as a step-by-step switching device. To this end, a hub member of the swashplate member is pivotally adjusted on a supporting member relative thereto by adjustment of a swashplate angle and is formlockingly connected with the supporting member in its respective relative pivotal position by coupling elements, with the supporting member being mounted on an intermediate shaft at an acute angle. With the step-by-step switching device, an axial displacement of the intermediate shaft is converted in a stepwise rotary adjustment of the hub member for changing the swashplate angle.

The drawback of the solution of the German Publication DE 32 05 141 A1 consists in that the step-by-step switching device can be actuated only when the hand-held power tool is switched off. Moreover, the step-by-step switching device is constructively very expensive.

Accordingly, an object of the present invention is to provide a hand-held power tool of the type discussed above and in which the above-discussed drawbacks of the known power tool are eliminated.

SUMMARY OF THE INVENTION

This and other objects of the present invention, which will become apparent hereinafter are achieved by providing, in a hand-held power tool, an adjusting device having an adjustment member displaceable along a longitudinal extent of the swashplate member for steplessly adjusting a swashplate angle whereby a stepless adjustment of the stroke path of the driving member became possible.

The stepless adjustment makes possible adjustment of the stroke path of the driving member also during the operation of the power tool. Thereby, the percussion mechanism of the power tool can be adapted during the operation of the power tool, to changing physical characteristics of the to-be-treated constructional component, e.g., at a transition from plasterwork to brick masonry or concrete.

The stepless adjustment of the stroke path of the driving member or the driving piston further makes it possible to adapt the percussion mechanism to different working tool or bore diameters.

According to an advantageous, constructively simple embodiment, there is provided a hub member for transmitting the stroke movement to the swashplate member with the hub member being displaceable by the adjusting member along the longitudinal extent of the swashplate member relative thereto. The hub member serves not only for transmitting the motor-generated displacement energy to the swashplate member but as an adjustment element of the adjustment device for adjusting the displacement stroke of the driving member, is also adjustable by a maximum possible swashplate angle of the swashplate member.

Advantageously, the hub member has a bearing support through which a swashplate member is displaceable. This permits to provide, in a constructively simple manner, for joint displacement of the hub member with the swashplate member along the stroke axis of the hub member.

Advantageously, the hub member has an elongate opening for a rotatable eccentric journal spaced in a longitudinal direction of the hub member from the bearing support, whereby the hub member can be axially displaced along a longitudinal extent of the eccentric journal by the adjusting member. This permits to convert, in a technically simple manner, a rotational movement which is transmitted from the motor by the eccentric journal, in a reciprocating movement of the hub member. The eccentric journal is formed as an elongate element to ensure its engagement in the longitudinal opening of the hub member in all of the adjustment positions of the hub member.

Advantageously, the swashplate member is pivotally supported in a bearing support of the hub member by a pivot sleeve. This ensures a low-wear support of the swashplate member.

Advantageously, the pivot sleeve has a ball-shaped outer configuration, and the bearing support has an inner profile corresponding to a curvature of the ball-shaped outer configuration of the pivot sleeve. Thereby a loss-poor rotational movement of the swashplate member relative to the hub member becomes possible while simultaneously, an adjustment movement of the hub member relative to the swashplate member is also possible when the hub member is displaced along the longitudinal extent of the swashplate member by the adjusting member.

According to an advantageous, technically simple embodiment there is provided a manually actuatable actuation member for the adjusting member. The actuation member ensures that a power tool user can adjust the swashplate angle of the swashplate number and, thereby, the stroke of the driving member in a simple manner.

Advantageously, the adjusting member has a first adjusting element cooperating with a second adjusting element provided on the actuation member. Thereby in a constructively simple manner, a displacement connection between the actuation member and the adjusting member of the adjustment device is achieved.

In an advantageously easily operable, by the user, embodiment, the actuation member is formed as a thumb wheel.

Advantageously, the swashplate member has, at its end remote from the driving member, a support member pivotally supported on a counter-support member and axially fixed with respect to its longitudinal extent. This ensures a low-wear and a long-lasting pivotal support of the swashplate member. The support member is formed advantageously as a ball head pivotally supported in a counter-support member formed as a socket of a ball and socket joint but axially fixed (with respect to its longitudinal extent).

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
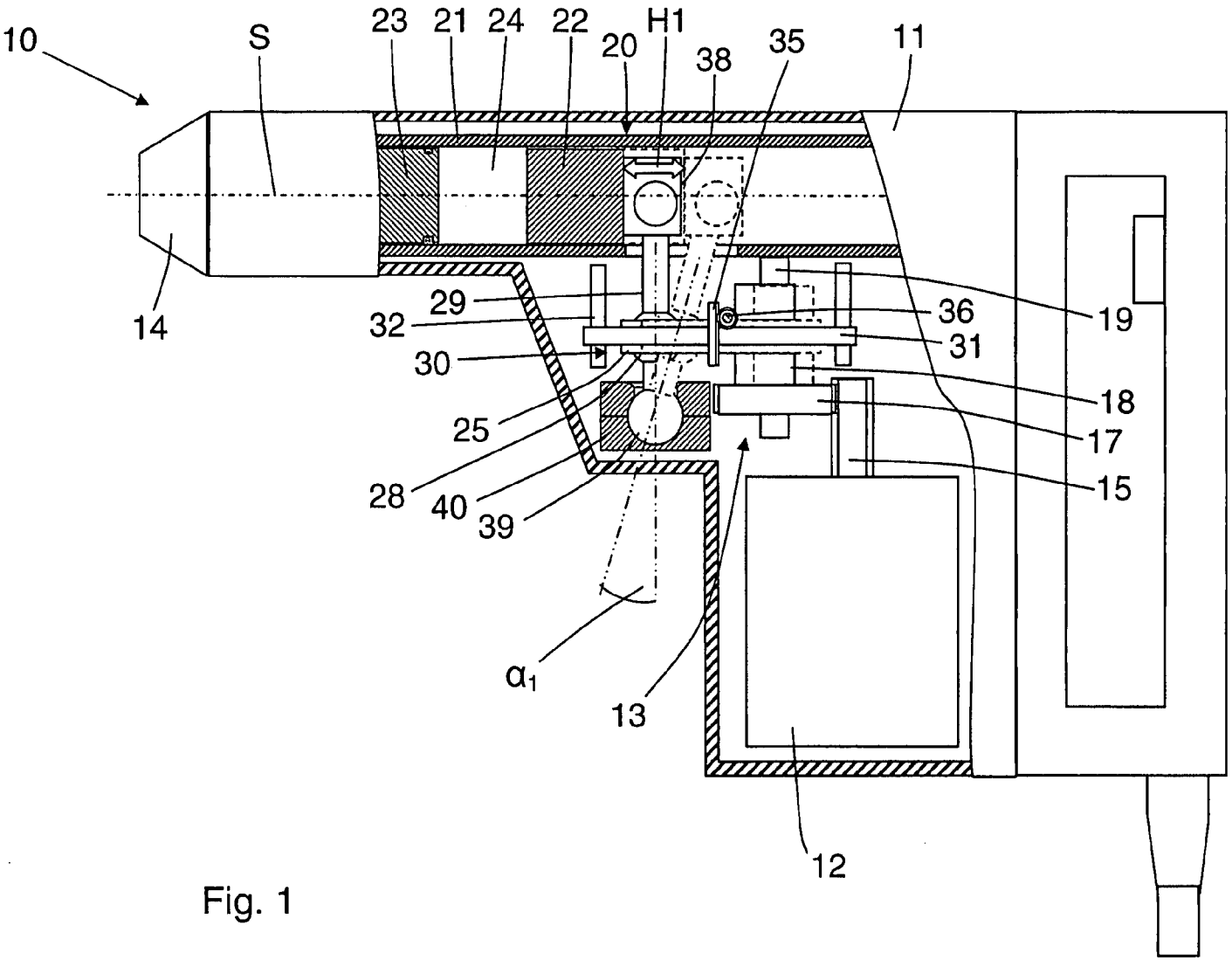
FIG. 1 a side, partially cross-sectional view of a hand-held power tool according to the present invention with a pneumatic percussion mechanism and a device for adjusting a stroke of the driving member, with the adjusting device occupying a first adjustment position.
Figure 2:
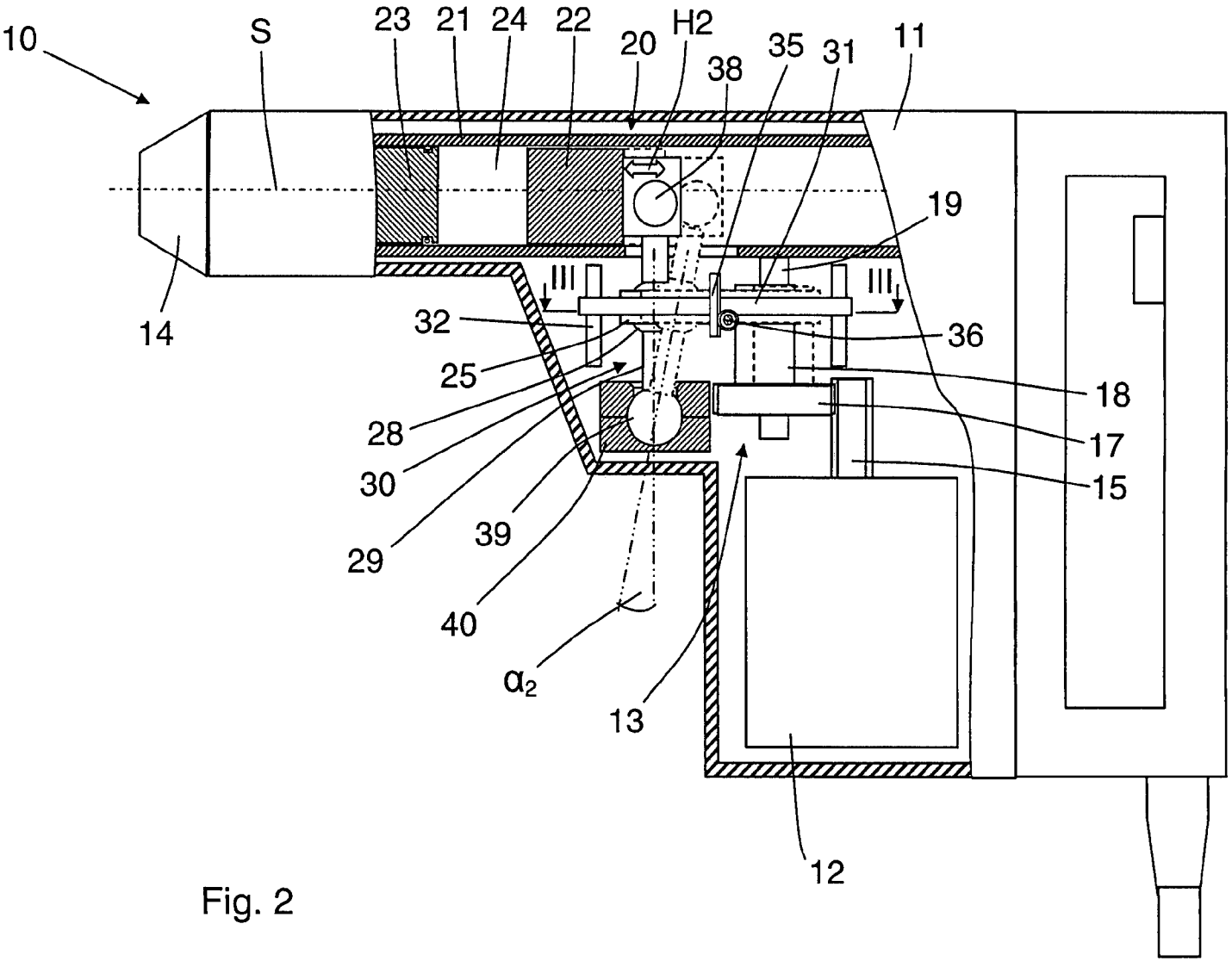
FIG. 2 a view similar to that of FIG. 1 but with the adjusting device occupying a second adjustment position.
Figure 3:
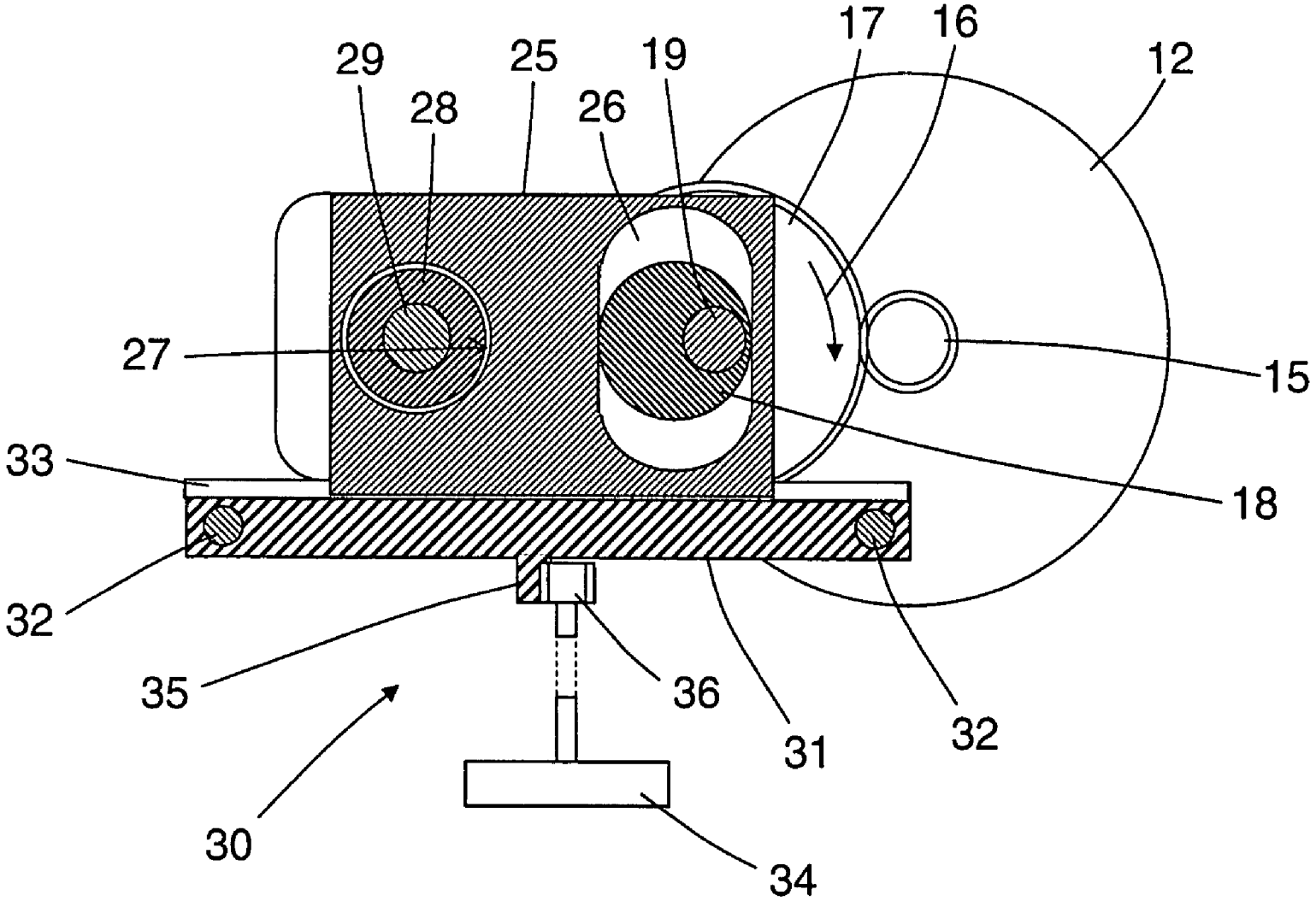
FIG. 3 a cross-sectional view of the hand-held power tool shown in FIG. 2 along line III-III.

A hand-held power tool 10 according to the present invention which is formed as a rotary-percussion combination hammer and is shown in FIG. 1-3, includes a housing 11, in which there are arranged a percussion mechanism 20 for operating a working tool receivable in a tool holder 14, a swashplate drive for driving the percussion mechanism and generally designated with a reference numeral 13, and a motor 12.

The percussion mechanism 20 includes a guide tube 21 in which a driving member 22, which is formed as a driving piston, reciprocates. For simplification of the assembly operation, the guide tube 21 can be formed of two or more parts. The percussion mechanism 20 defines a central percussion axis S that extends centrally through the guide tube 21 and elements (the driving member 22) displaceable in the guide tube. A percussion member 23, which is formed as a percussion piston, is supported in the guide tube 21 for an axial displacement therein. The percussion member 23 likewise performs an oscillating reciprocating movement that is applied thereto by the driving member 22 via an air spring 24. The percussion member 23 applies blows during a percussion operation to an anvil (not shown in the drawings) which, in turn applies blows to a working tool (likewise not shown in the drawing). Alternatively, the percussion member 23 can apply blows directly to the end of the working tool. The air spring 24 or the gas spring (according to the used gas or gas mixture), which is located between the driving member 22 and the percussion member 23, can be actuated and deactuated by switching means (not shown in the drawings).

For generating its reciprocating movement during an operation of the hand-held power tool 10, the driving member 22 is connected (at a pivot support 38) with a swashplate member 29 of the swashplate drive 13 and which is pivotally supported on the power tool 10. A pivot sleeve 28 is displaceably supported on the swashplate member 29. The pivot sleeve 28 is circumferentially shaped as a ball and is pivotally supported in a bearing support 27 in a disc-shaped hub member 25 of the swashplate drive 13. On its part, the hub member 25 is displaced along its longitudinal extent, with its projection formed as a dovetail projection engaging in a guide groove 33 formed as a dovetail groove. The guide groove 33 forms part of a device for adjusting the stroke of the driving member 22 and generally designated with a reference numeral 30. The hub member 25 has, at its end region remote from the bearing support 27, an elongate opening 26 extending transverse to its longitudinal extent and through which an elongate eccentric journal 18, which together with an eccentril wheel 17 is fixedly supported on a support shaft 19, is guided. The eccentric wheel 17 has an outer toothing that cooperates with the toothing of the output shaft 15 of the motor 12. The swashplate member 29, which is formed, e.g., as an elongate round bar, has at its end remote from the driving member 22, a support member 39 formed an a ball head pivotally supported in a counter-support member 40, which is formed as a socket of a ball and socket joint, but without a possibility of an axial displacement (with respect to its longitudinal extent).

During operation of the power tool 10, the rotational movement of the motor 12 is transmitted to the eccentric wheel 17 and the eccentric journal 18 (in the rotational direction shown with arrow 16 in FIG. 3) and then is converted by the eccentric journal 18, which is displaceable in the elongate opening 26, in a linear reciprocating movement of the hub member 25. The hub member 25 transmits its reciprocating movement only to the swashplate member 29, whereby the linear reciprocating movement of the hub member 25 is converted in a reciprocating pivotal movement of the swashplate member 29 (as shown with dot-dash lines in FIGS. 1-2) that pivots maximum about a swashplate angle $\alpha_1$.

The swashplate member 29 transmits this movement again via the pivot support 38 to the driving member 22 that reciprocates linearly along the percussion axis S. The driving member 22 has a maximal stroke length H1 (see FIG. 1).

The above-mentioned adjustment device 30 for adjusting the stroke of the driving member 22 has, in addition to the adjusting member 31, also an actuation member 34 which is formed, e.g., as a thumb wheel. The actuation member 34 is, e.g., manually actuated and is accessible from outside of the hand-held power tool 10. On the adjusting member 31, a first adjusting element 35 is fixedly secured. The first adjusting element 35, which is formed as a toothed rack, cooperates with a second adjusting element 36 which is formed as a toothed gear and is arranged on the actuation member 34. The adjusting member 31, which is displaceable along a bar-shaped guide member 32, can steplessly reciprocate, upon rotation of the actuation member 34, between a first end position adjacent to the eccentric wheel 17 (see FIG. 1) and a second end position remote from the eccentric wheel 17 (see FIG. 2). The adjusting member 31 changes the position of the hub member 25 along the eccentric journal 18 and along the longitudinal extent of the swashplate member 29, and the hub member 25 steplessly changes the swashplate angle $\alpha_1$ of the swashplate member 29. The stepless adjustment of the swashplate angle between a maximal swashplate angle $\alpha_1$ (see FIG. 1) and a minimal swashplate angle $\alpha_2$ (see FIG. 2) provides for a stepless adjustment of a maximal stroke path of the driving member 22 between a maximal stroke length H1 (see FIG. 1) and a minimal stroke length H2 (see FIG. 2). The adjustment of the stroke length of the driving member 22, which is based on its stepless adjustability, is also possible during operation of the hand-held power tool 10. This permits to rapidly react to changes in physical properties of the to-be treated constructional component or workpiece. This can occur, e.g., in case when, firstly, plasterwork is percussively drilled with the hand-held power tool 10 and then brick masonry, which lies beneath the plaster work, is drilled.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held power tool, comprising:

a pneumatic percussion mechanism (20) defining a central percussion axis (S) and having a guide tube (21), a driving member (22) reciprocating in the guide tube (21), a percussion member (23) driven by the driving member (22), and an air spring (24) located between the driving member (22) and the percussion member (23) for transmitting a reciprocating movement of the driving member (22) to the percussion member (23);

a motor (12) for driving the percussion mechanism (20);

a motor-driven elongate swashplate member (29) for reciprocating the driving member (22);

an adjustment device (30) for adjusting a displacement stroke of the driving member (22) and including an adjusting member (31) displaceable along a longitudinal extent of the swashplate member (29) for adjusting a swashplate angle that determines the displacement stroke of the driving member (22); and a hub member (25) for transmitting the stroke movement to the swashplate member (29), wherein the hub member (25) is displaceable by the adjusting member (31) along the longitudinal extent of the swashplate member (29) relative thereto and wherein the hub member (25) has a bearing support (27) through which the swashplate member (29) is displaceable.

2. A hand-held power tool according to claim 1, wherein the hub member (25) has an elongate opening (26) for a rotatable eccentric journal (18) spaced in a longitudinal direction of the hub member (25) from the bearing support (27), the hub member (25) being axially displaceable along a longitudinal extent of the eccentric journal (18) by the adjusting member (31).

3. A hand-held power tool according to claim 1, further comprising a pivot sleeve (28) for pivotally supporting the swashplate member (29) in the bearing support (27).

4. A hand-held power tool according to claim 3, wherein the pivot sleeve (28) has a ball-shaped outer configuration, and the bearing support (27) has an inner profile corresponding to a curvature of the ball-shaped outer configuration of the pivot sleeve (28).

5. A hand-held power tool according to claim 1, wherein the adjustment device (30) includes a manually actuatable actuation member (34) for the adjusting member (31).

6. A hand-held power tool according to claim 5, wherein the adjusting member (31) has a first adjusting element (35) cooperating with a second adjusting element (36) provided on the actuation member (34).

7. A hand-held power tool according to claim 5, wherein the actuation member (34) is formed as a thumb wheel.

8. A hand-held power tool according to claim 1, wherein the swashplate member (29) has, at an end thereof remote from the driving member (22), a support member (39) pivotally supported on a counter-support member (40) and axially fixed with respect to a longitudinal extent thereof.

9. A hand-held power tool, comprising:

a pneumatic percussion mechanism (20) defining a central percussion axis (S) and having a guide tube (21), a driving member (22) reciprocating in the guide tube (21), a percussion member (23) driven by the driving member (22), and an air spring (24) located between the driving member (22) and the percussion member (23) for transmitting a reciprocating movement of the driving member (22) to the percussion member (23);

a motor (12) for driving the percussion mechanism (20);

a motor-driven elongate swashplate member (29) for reciprocating the driving member (22); and an adjustment device (30) for adjusting a displacement stroke of the driving member (22) and including an adjusting member (31) displaceable along a longitudinal extent of the swashplate member (29) for adjusting a swashplate angle that determines the displacement stroke of the driving member (22), wherein the adjustment device (30) includes a manually actuatable actuation member (34) for the adjusting member (31) and wherein the adjusting member (31) has a first adjusting element (35) cooperating with a second adjusting element (36) provided on the actuation member (34).

10. A hand-held power tool, comprising:

a pneumatic percussion mechanism (20) defining a central percussion axis (S) and having a guide tube (21), a driving member (22) reciprocating in the guide tube (21), a percussion member (23) driven by the driving member (22), and an air spring (24) located between the driving member (22) and the percussion member (23) for transmitting a reciprocating movement of the driving member (22) to the percussion member (23);

a motor (12) for driving the percussion mechanism (20);

a motor-driven elongate swashplate member (29) for reciprocating the driving member (22), wherein the swashplate member (29) has, at an end thereof remote from the driving member (22), a support member (39) pivotally supported on a counter-support member (40) and axially fixed with respect to a longitudinal extent thereof; and an adjustment device (30) for adjusting a displacement stroke of the driving member (22) and including an adjusting member (31) displaceable along a longitudinal extent of the swashplate member (29) for adjusting a swashplate angle that determines the displacement stroke of the driving member (22).

* * * * *